US010539051B2

(12) United States Patent
Wigsten et al.

(10) Patent No.: US 10,539,051 B2
(45) Date of Patent: Jan. 21, 2020

(54) VALVE OPERATING SYSTEM PROVIDING VARIABLE VALVE LIFT AND/OR VARIABLE VALVE TIMING

(71) Applicant: BorgWarner Inc., Auburn Hills, MI (US)

(72) Inventors: Mark M. Wigsten, Ithaca, NY (US); Dale N. Smith, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/772,993

(22) PCT Filed: Nov. 3, 2016

(86) PCT No.: PCT/US2016/060244
§ 371 (c)(1),
(2) Date: May 2, 2018

(87) PCT Pub. No.: WO2017/079383
PCT Pub. Date: May 11, 2017

(65) Prior Publication Data

US 2018/0320566 A1 Nov. 8, 2018

Related U.S. Application Data

(60) Provisional application No. 62/251,972, filed on Nov. 6, 2015, provisional application No. 62/251,959, filed on Nov. 6, 2015.

(51) Int. Cl.
*F01L 13/00* (2006.01)
*F01L 1/02* (2006.01)
(Continued)

(52) U.S. Cl.
CPC ..... *F01L 13/0036* (2013.01); *F01L 1/022* (2013.01); *F01L 1/047* (2013.01); *F01L 1/053* (2013.01);
(Continued)

(58) Field of Classification Search
CPC ..... F01L 13/0036; F01L 1/022; F01L 1/047; F01L 1/053; F01L 1/3442;
(Continued)

(56) References Cited

U.S. PATENT DOCUMENTS 5,887,557 A 3/1999 Battlogg
5,950,583 A 9/1999 Kraxner et al.
(Continued)

FOREIGN PATENT DOCUMENTS

DE 102013223299 A1 * 5/2015 ..... F01L 13/0036
JP 2007262957 A 10/2007

OTHER PUBLICATIONS

PCT International Search Report dated May 17, 2018 for corresponding PCT application No. PCT/US2016/060244, filed Nov. 3, 2016.

*Primary Examiner* — Laert Dounis
*Assistant Examiner* — Kelsey L Stanek
(74) *Attorney, Agent, or Firm* — Harness, Dickey & Pierce, P.L.C.

(57) ABSTRACT

A valve operating system that includes a plurality of cam assemblies that are coupled for rotation about a rotary axis. Each of the cam assemblies has a control link and a first cam member. Each of the control links has a link body, which forms a majority of the control link, and that extends parallel to the rotary axis. Each of the first cam members is coupled to one of the control links for axial movement therewith along the rotary axis between first and second positions to alternate between first and second cam profiles, respectively.

32 Claims, 11 Drawing Sheets

(51) Int. Cl.
*F01L 1/053* (2006.01)
*F01L 1/047* (2006.01)

(52) U.S. Cl.
CPC ..... *F01L 2001/0473* (2013.01); *F01L 2001/0476* (2013.01); *F01L 2013/0052* (2013.01); *F01L 2013/10* (2013.01); *F01L 2013/101* (2013.01); *F01L 2810/03* (2013.01)

(58) Field of Classification Search
CPC ..... F01L 2001/0473; F01L 2001/0476; F01L 2013/0052; F01L 2013/10; F01L 2013/101; F01L 2810/03; F01L 2820/01
USPC ..... 123/90.18
See application file for complete search history.

(56) References Cited

U.S. PATENT DOCUMENTS 6,332,445 B1 12/2001 Voss et al.
6,357,404 B1 3/2002 Deeg
6,397,802 B1 6/2002 Rutschmann et al.
6,725,818 B2 4/2004 Methley
7,404,383 B2 7/2008 Elendt
7,409,938 B2 8/2008 Dengler
7,467,042 B2 12/2008 Sikora et al.
7,472,671 B2 1/2009 Elendt et al.
7,762,225 B2 7/2010 Dengler
8,100,099 B2 1/2012 Budack et al.
8,186,320 B2 5/2012 Schiepp et al.
8,191,524 B2 6/2012 Elendt et al.
8,201,530 B2 6/2012 Talan et al.
8,225,759 B2 7/2012 Wutzler et al.
8,230,833 B2 7/2012 Werler et al.
8,235,014 B2 8/2012 Talan et al.
8,291,877 B2 10/2012 Meintschel et al.
8,297,247 B2 10/2012 Schoeneberg et al.
8,307,797 B2 11/2012 Meintschel et al.
8,353,264 B2 1/2013 Meintschel et al.
8,365,692 B2 2/2013 Schoeneberg et al.
8,387,579 B2 3/2013 Stolk et al.
8,418,667 B2 4/2013 Nendel
8,474,424 B2 7/2013 Meintschel et al.
8,544,430 B2 10/2013 Elendt et al.
8,567,361 B2 10/2013 Gruberger
8,584,632 B2 11/2013 Stiegler et al.
8,584,639 B2 11/2013 Elendt et al.
8,596,235 B2 12/2013 Arnold et al.
8,596,238 B2 12/2013 Werler et al.
8,607,750 B2 12/2013 Parsche
8,662,043 B2 3/2014 Dollinger et al.
8,695,547 B2 4/2014 Weinmeister
8,695,549 B2 4/2014 Richter
8,701,609 B2 4/2014 Wahl et al.
8,701,610 B2 4/2014 Schwarzenthal et al.
8,746,194 B2 6/2014 Werler et al.
8,746,195 B2 6/2014 Werler et al.
8,833,319 B2 9/2014 Kraus
8,844,130 B2 9/2014 Scherzinger et al.
8,863,714 B1 10/2014 Moran et al.
8,887,681 B2 11/2014 Wiesner et al.
8,893,674 B2 11/2014 Lengfeld et al.
8,893,678 B2 11/2014 Schadel et al.
8,904,977 B2 12/2014 Werler et al.
8,910,544 B2 12/2014 Manteufel et al.
8,960,141 B2 2/2015 Luedemann et al.
8,960,143 B2 2/2015 Meintschel et al.
8,997,706 B2 4/2015 Stolk et al.
9,004,031 B1 4/2015 Choi
9,010,290 B2 4/2015 Choi et al.
9,027,520 B2 5/2015 Gunnel et al.
9,038,584 B2 5/2015 Kashiwabara et al.
9,046,011 B2 6/2015 Kujas et al.
9,097,144 B2 8/2015 Kappler
9,103,243 B2 8/2015 Hartlieb et al.
9,115,613 B2 8/2015 Deblaize et al.
9,121,354 B2 9/2015 Kirbach et al.
9,140,147 B2 9/2015 Woo et al.
9,228,456 B2 1/2016 Gross et al.
2003/0111031 A1* 6/2003 Hendricksma ..... F01L 1/18 123/90.15
2013/0104824 A1* 5/2013 Weinmeister ..... F01L 1/04 123/90.18
2014/0251250 A1* 9/2014 Woo ..... F01L 13/0036 123/90.18
2015/0204219 A1 7/2015 Takagi et al.
2016/0281553 A1* 9/2016 Elendt ..... F01L 13/0036

* cited by examiner

VALVE OPERATING SYSTEM PROVIDING VARIABLE VALVE LIFT AND/OR VARIABLE VALVE TIMING

CROSS-REFERENCE TO RELATED APPLICATIONS

This application claims the benefit of U.S. Provisional Application No. 62/251,959 entitled "Cam Lobe Switching Mechanism Using Control Rods Inside The Camshaft", filed on Nov. 6, 2015 and U.S. Provisional Application No. 62/251,972 entitled "Mechanical Variable Valve Life Actuator For Cam Lobe Switching Mechanism Using Control Rods Inside The Camshaft", filed on Nov. 6, 2015. The entire disclosures of each of the above applications are incorporated herein by reference as if fully set forth in their entirety.

FIELD

The present disclosure relates to a valve operating system that provides variable valve lift and/or variable valve timing.

BACKGROUND

This section provides background information related to the present disclosure which is not necessarily prior art.

Modern automotive four-stroke internal combustion engine are typically configured with intake and exhaust valves that can be selectively opened via a valve operating system to intake air or an air-fuel mixture into the engine cylinders and to exhaust gasses from the engine cylinders. A valve operating system with a camshaft is commonly employed to control the timing and duration of the opening of the several valves. The camshaft typically includes several cam lobes, with each of the cam lobes having a shape that determines the duration that one or more associated valves are opened, as well as the amount by which the one or more associated valves are opened. It will be appreciated, too, that the position of an associated one of the cam lobes about the rotary axis of the camshaft determines the timing or phase of the opening of the one or more associated valves. The combination of the shape and phase of a cam lobe will be referred to herein as "cam profile".

The operation of such internal combustion engines are greatly affected by the timing and duration of the opening of the intake valves and the exhaust valves and as such, it is known in the art to configure a camshaft with multiple sets of cam lobes that can be employed on an alternative basis to provide variable valve lift and/or variable valve timing. While such valve operating systems are suited for their intended purpose, they are nevertheless susceptible to improvement.

SUMMARY

This section provides a general summary of the disclosure, and is not a comprehensive disclosure of its full scope or all of its features.

In one form, the present teachings provide a valve operating system that includes a plurality of cam assemblies. The cam assemblies are coupled for rotation about a rotary axis. Each of the cam assemblies has a control link and a first cam member. Each of the control links has a link body, which forms a majority of the control link, and that extends parallel to the rotary axis. Each of the first cam members is coupled to a corresponding one of the control links for axial movement therewith along the rotary axis. Each of the first cam members has a first cam configuration, which has a first predetermined lift profile, and a second cam configuration that has a second predetermined lift profile that is different from the first predetermined lift profile. Each of the cam assemblies is slide-able along the rotary axis between a first position, in which the first cam configurations are positioned in associated activated locations and each of the second cam configurations is offset along the rotary axis from their associated activated location, and a second position, in which the second cam configurations are positioned in the associated activated locations and each of the first cam configurations is offset along the rotary axis from their associated activated location.

The first cam members can be axially slidably coupled to a cam tube and the link bodies are received in the cam tube. Optionally, the first cam members can be non-rotatably coupled to the cam tube. Each of the first cam members can define a plurality of internal teeth that can meshingly engage a plurality of external teeth on the cam tube. Each of the cam assemblies can further include a detent mechanism that is configured to releasably secure the first cam members to the cam tube. Optionally, each of the detent mechanisms can include first and second recesses formed in the cam tube, a detent member received in a hole in an associated one of the first cam members, and a band spring that is received about the associated one of the first cam members. The band spring can urge the detent member toward the cam tube and can limit movement of the detent member relative to the associated one of the first cam members in a radially outward direction from the cam tube. Receipt of the detent member into the first recess releasably secures an associated one of the cam assemblies in the first position, while receipt of the detent member into the second recess releasably secures the associated one of the cam assemblies in the second position. The detent member can optionally be a spherical ball.

The valve operating system can optionally include a spacer that is received within the cam tube and which forms a plurality of link slots. Each of the control links can be received in a corresponding one of the link slots. Optionally, a lateral cross-section of the spacer taken perpendicular to the rotary axis can be X-shaped or Y-shaped.

Each of the cam assemblies can further include a second cam member that is coupled to an associated one of the control links for axial movement therewith along the rotary axis. The second cam member is spaced apart axially along the rotary axis from the first cam member.

Each of the control links can further include an engagement member that extends radially outwardly from the link body and engages a corresponding one of the first cam members. The engagement member can be a discrete component that is assembled to the link body, for example by welding.

Each of the first cam members can optionally have a third cam configuration with a third predetermined lift profile. The third predetermined lift profile of at least a portion of the third cam configurations can be different from the first predetermined lift profile and the second predetermined lift profile. Each of the cam assemblies is slide-able along the rotary axis to a third position that is intermediate the first and second positions. Placement of the cam assemblies into their third position in which the third cam configurations are positioned in the associated activated locations and each of the first and second cam configurations is offset along the rotary axis from the associated activated locations.

The second predetermined lift profile differs from the first predetermined lift profile in at least one of a value of maximum lift and a rotational timing of the value of maximum lift.

In another form, the present teachings provide a valve operating system that includes a cam tube, which is rotatable about a rotary axis, a plurality of cam assemblies and a plurality of actuator segments. The cam assemblies are coupled for rotation about a rotary axis. Each of the cam assemblies has a control link and a first cam member. Each of the control links has a link body, which forms a majority of the control link, and that extends parallel to the rotary axis. Each of the first cam members is coupled to a corresponding one of the control links for axial movement therewith along the rotary axis. Each of the first cam members has a first cam configuration, which has a first predetermined lift profile, and a second cam configuration that has a second predetermined lift profile that is different from the first predetermined lift profile. Each of the cam assemblies is slide-able along the rotary axis between a first position, in which the first cam configurations are positioned in associated activated locations and each of the second cam configurations is offset along the rotary axis from their associated activated location, and a second position, in which the second cam configurations are positioned in the associated activated locations and each of the first cam configurations is offset along the rotary axis from their associated activated location. Each of the actuator segments is non-rotatably but axially slidably coupled to the cam tube and axially fixed to an associated one of the control links. Each of the actuator segments defines first and second ramp profiles that extend in a circumferential direction about the actuator segment. The first ramp profile has a first ramp section and a second ramp section that is offset axially along the rotary axis from the first ramp section. The second ramp profile has a third ramp section and a fourth ramp section that is offset axially along the rotary axis from the third ramp section.

The first ramp profile can be formed by a first groove and the second ramp profile can be formed by a second groove that is spaced axially apart from the first groove along the rotary axis. The valve operating system can further include a first pin that is selectively engagable to the first ramp profile and a second pin that is selectively engagable to the second ramp profile. Each of the first and second pins can have a longitudinal axis that is disposed perpendicular to the rotary axis. The valve operating system can further include a first solenoid, which is selectively operable for translating the first pin radially toward the rotary axis, and a second solenoid that is selectively operable for translating the second pin radially toward the rotary axis.

The first ramp profile of at least one of the actuator segments can optionally include an engagement section. The second ramp section can be disposed between the first transition section and the engagement section. A portion of the first groove that forms the engagement section can have a bottom wall that tapers radially inwardly with increasing circumferential distance from the second ramp portion. The engagement section can be configured to receive the first pin without contact between the first pin and the engagement section causing movement of the at least one of the actuator segments along the rotary axis.

The first and second ramp profiles can be formed by a common groove. The first and second ramp profiles can be spaced axially apart from one another. The valve operating system can include at least one pin that is selectively engagable to the first ramp profile and the second ramp profile. The at least one pin has a longitudinal axis that is disposed perpendicular to the rotary axis. The valve operating system can further include at least one solenoid that is selectively operable for translating the at least one pin into engagement with the first ramp profile on the actuator segments. The at least one solenoid can be configured to translate the at least one pin parallel to the rotary axis.

The cam tube can define a plurality of arm members onto which the actuator segments are non-rotatably and axially slidably mounted. Optionally, the arm members number two in quantity.

The valve operating system can further include at least one pin that is selectively engagable to the first and second ramp profiles.

The first and second ramp profiles can be different from one another so as not to have reflection symmetry about a plane that is perpendicular to the rotary axis and equidistant from the first and second ramp profiles. For example, the first ramp profile can have a first transition section that is disposed between the first ramp section and the second ramp section, the second ramp profile can have a second transition section that is disposed between the third ramp section and the fourth ramp section, and the first and second intermediate sections can be configured so that they are not mirror images of one another.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
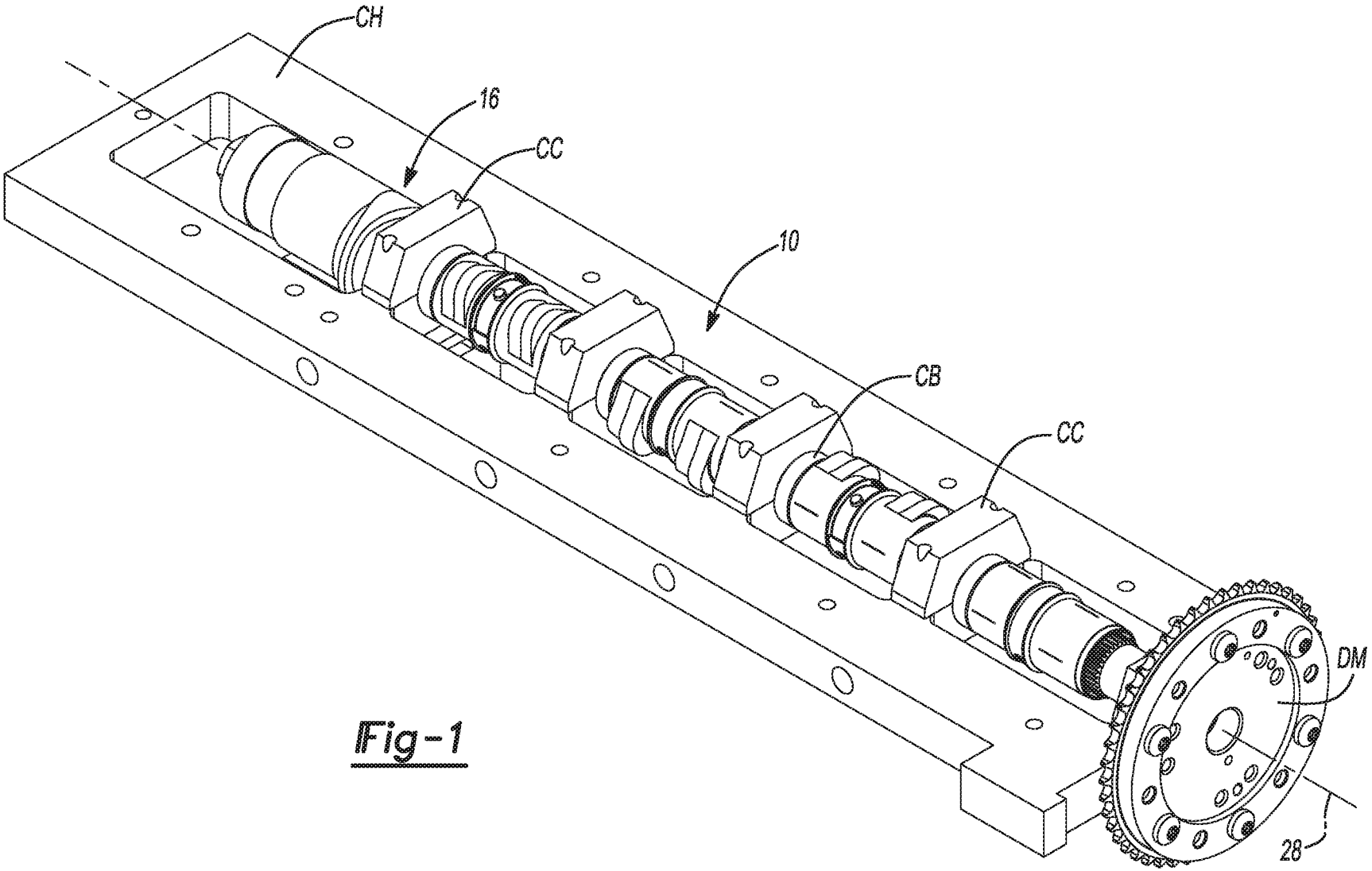
FIG. 1 is a perspective view of a portion of an internal combustion engine having a valve operating system constructed in accordance with the teachings of the present disclosure.
Figure 2:
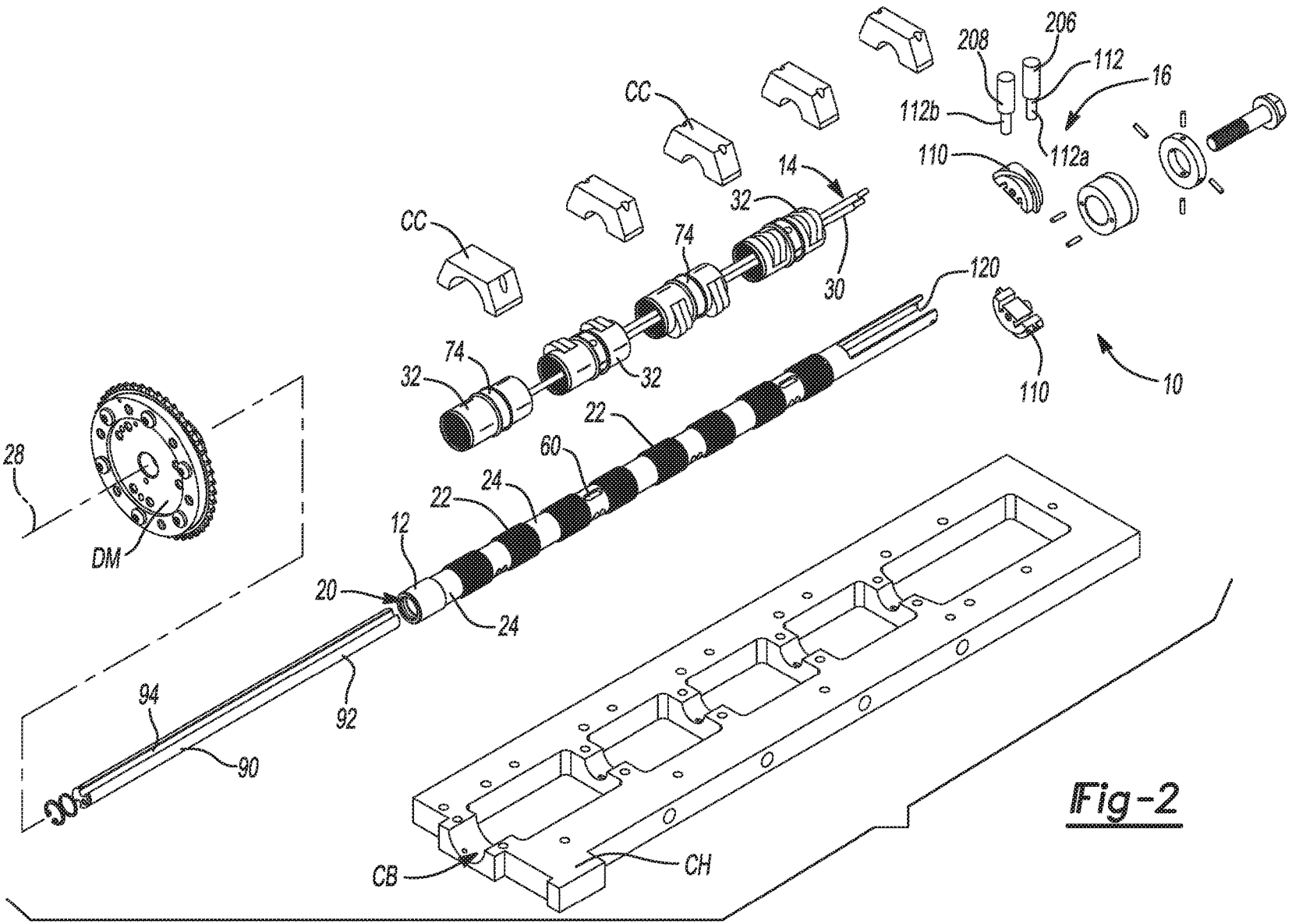
FIG. 2 is an exploded perspective view of the valve operating system of FIG. 1.

With reference to FIGS. 1 and 2, a portion of an internal combustion engine is illustrated as having a valve operating system 10 constructed in accordance with the teachings of the present disclosure. The internal combustion engine in the particular example illustrated is a four cylinder overhead cam engine with an in-line cylinder configuration, but it will be appreciated that the teachings of the present disclosure have application to other engine configurations and as such, it will be understood that the scope of the present disclosure is not limited to engines with an overhead cam engines or to engines with an in-line cylinder configuration. The engine can include a cylinder head CH and a drive means DM for providing rotary power to drive the valve operating system 10, such as a cam gear, cam sprocket or cam pulley. Except as otherwise noted herein, the cylinder head CH and drive means DM can be configured in a well-known and conventional manner. The valve operating system 10 can include a cam tube 12, a plurality of cam assemblies 14 and an actuator 16.

Figure 3:
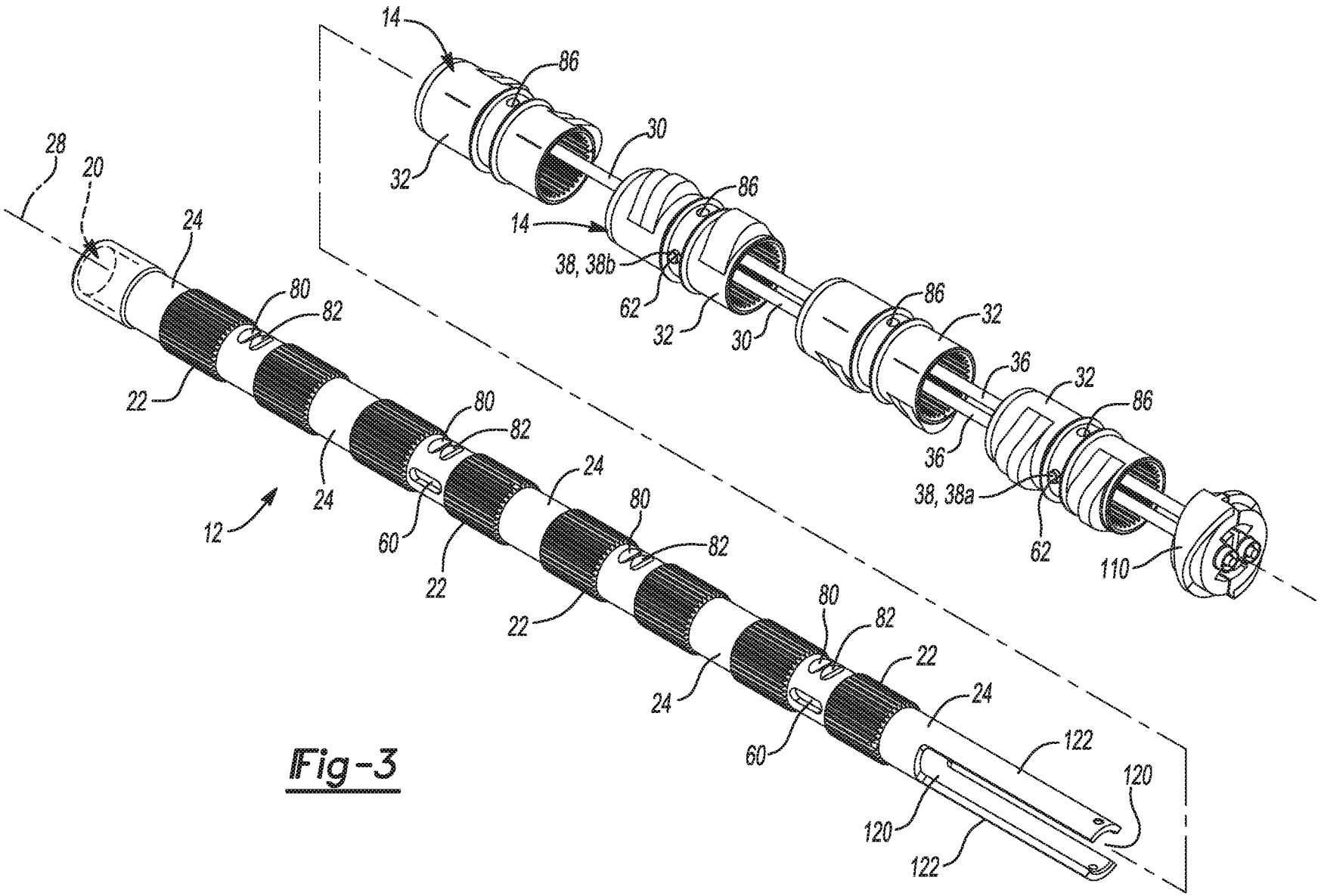
FIG. 3 is an exploded perspective view of a portion of the valve operating system of FIG. 1 illustrating a cam tube and cam assemblies in more detail.

With reference to FIGS. 2 and 3, the cam tube 12 can be coupled to the drive means DM to receive rotary power therefrom. In the example provided, the cam tube 12 is fixedly and non-rotatably coupled to the drive means DM, but it will be appreciated that a variable coupling could be employed to couple the cam tube 12 to the drive means DM to selectively alter the rotational position of the cam tube 12 relative to the drive means DM within a predetermined range to provide the valve operating system 10 with variable valve timing capabilities. The cam tube 12 can have a hollow interior 20 and can define a plurality of cam member mounts 22 and a plurality of journals 24. The journals 24 can be received in a cam bore CB that can be formed between the cylinder head CH and a plurality of cam caps CC that are fixedly but removably coupled to the cylinder head CH. A plurality of bearings (not specifically shown) can be disposed between the journals 24 and the cylinder head CH and the cam caps CC so that the cam tube 12 is supported relative to the cylinder head CH for rotation about a rotary axis 28.

Figures 4, 5, 6:
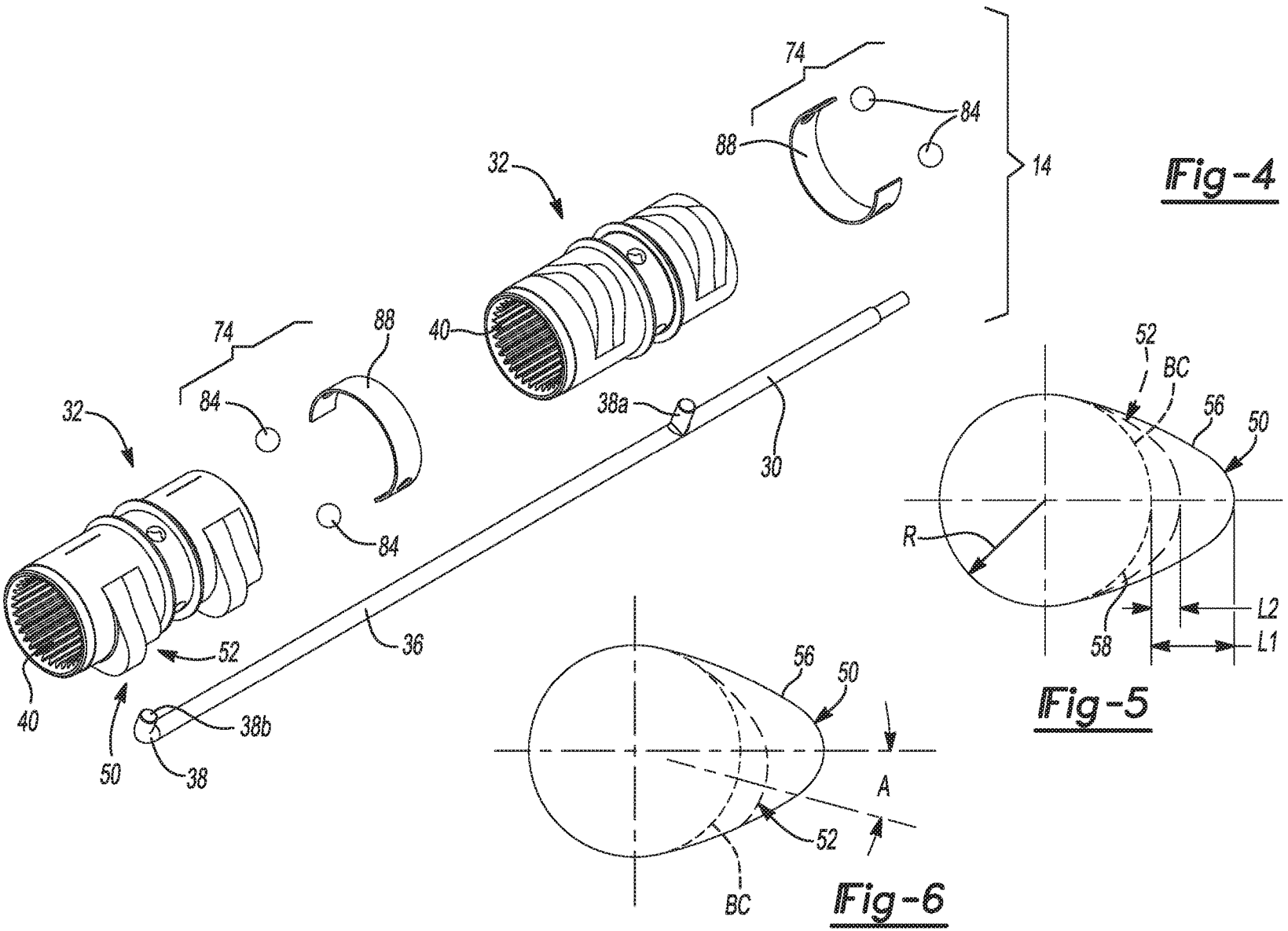
FIG. 4 is an exploded perspective view of the cam assembly depicted in FIG. 3.
FIG. 5 is a schematic illustration of a portion of a cam member of one of the cam assemblies that depicts a portion of the cam member as having first and second cam configurations.
FIG. 6 is similar to that of FIG. 5, but also depicts a difference in the phasing of the first and second cam configurations.

In FIGS. 2 and 4, each of the cam assemblies 14 can include a control link 30 and one or more cam members 32. The control links 30 can have a link body 36 and one or more engagement members 38. The link body 36 can form a majority of the control link 30 and can extend within the hollow interior 20 of the cam tube 12 along the rotary axis 28 (i.e., parallel to the rotary axis 28). Each of the engagement members 38 can be coupled to the link body 36 for translation with the link body 36 along the rotary axis 28 and can extend radially outwardly from the link body 36. In the example provided, a first one of the engagement members **38*a* is formed of a component that is assembled to the link body 36 and secured together with a suitable coupling means, such as a weld and/or fasteners, while a second one of the engagement members 38*b* is unitarily and integrally formed with the link body 36 (e.g., as a hook or projection that extends perpendicular to the link body 36). It will be appreciated, however, that all of the engagement members 38 could be discrete components that are assembled and secured to the link body 36 or that all of the engagement members 38 could be unitarily and integrally formed with the link body 36**, for example through bending, cold heading or forging.

Each of the cam members 32 can be axially slidably but non-rotatably coupled to the cam tube 12. In the example provided, each of the cam members 32 has an internally splined or toothed aperture 40 and is received over the cam tube 12 such that the internal teeth of the internally splined aperture 40 meshingly engage corresponding external teeth formed on the cam member mounts 22 on the cam tube 12.

Each of the cam members 32 can have a first cam configuration 50 and a second cam configuration 52 that are employed on an alternate basis to open a set of valves (not shown). Depending on the configuration of the engine, the set of valves may comprise solely one or more intake valves, or may comprise solely one or more exhaust valves, or may comprise both one or more intake valves and one or more exhaust valves. The first cam configuration 50 can have a first predetermined lift profile, while the second cam configuration 52 can have a second predetermined lift profile that is different from the first predetermined lift profile. With reference to FIG. 5, the first predetermined lift profile could include one or more first cam lobes 56 that are configured to provide a first maximum lift value L1 (i.e., the maximum radius of the first cam lobe 56 minus the radius R of the base circle BC of the first cam lobe 56), while the second predetermined lift profile could include one or more second cam lobes 58 that are configured to provide a second maximum lift value L2 that is different from the first maximum lift value L1. In situations where the first and second cam configurations 50 and 52 are configured to open a set of valves that comprises both one or more intake valves and one or more exhaust valves, it will be appreciated that the first and second cam lobes 56 and 58 (FIG. 5) mentioned previously are configured to open either the intake valve(s) or the exhaust valve(s), and that the first and second cam configurations 50 and 52 will additionally include one or more other cam lobes (not shown) that are configured to open the other type of valves (i.e., exhaust valves or intake valves) that are not opened by the first and second cam lobes 56 and 58 (FIG. 5). Additionally or alternatively, the first cam lobes 56 of the first predetermined lift profile could be timed (i.e., oriented about the rotary axis) differently from the second cam lobes 58 of the second predetermined lift profile as shown in FIG. 6 and as represented by the angle A.

With reference to FIGS. 2 and 3, each of the cam members 32 of a given one of the cam assemblies 14 can be coupled to the control link 30 of the given one of the cam assemblies 14 for axial movement with the control link 30 along the rotary axis 28. In the example provided, each of the engagement members 38 of the control links 30 are received through respective slotted apertures 60 (best shown in FIG. 3) formed in the cam tube 12 and are received into (and optionally through) respective apertures 62 formed in a respective one of the cam members 32.

Figure 7:
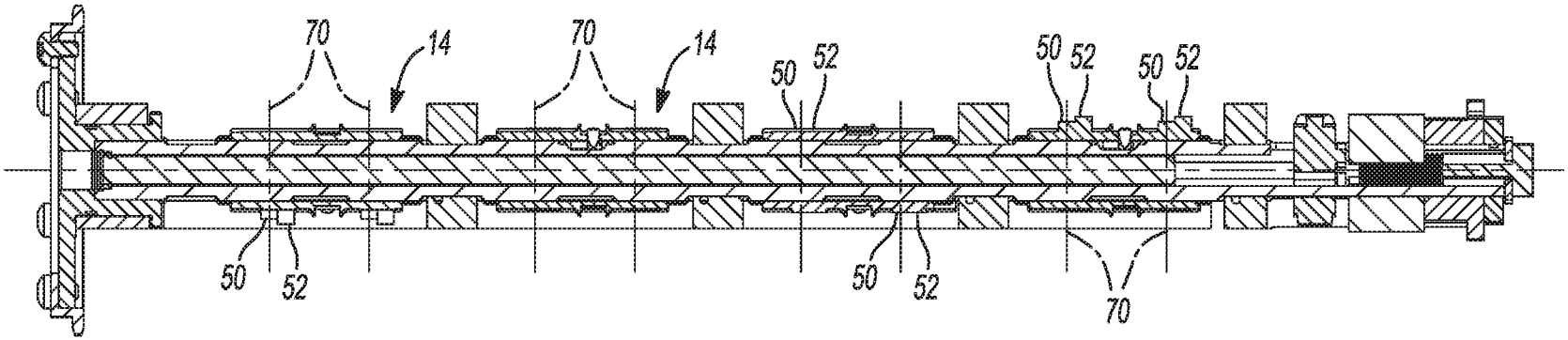
FIGS. 7 and 8 are longitudinal section views of the portion of the valve operating system of FIG. 1 depicting the cam assemblies in first and second positions, respectively.

Each of the cam assemblies 14 is slide-able along the rotary axis 28 between a first position (FIG. 7), in which the first cam configurations 50 are positioned in associated activated locations 70 and each of the second cam configurations 52 is offset along the rotary axis 28 from their associated activated location 70, and a second position (FIG. 8), in which the second cam configurations 52 are positioned in the associated activated locations 70 and each of the first cam configurations 50 is offset along the rotary axis 28 from their associated activated location 70.

Returning to FIGS. 2 and 4, each of the cam assemblies 14 can optionally include one or more detent mechanisms 74 that can be configured to releasably secure one or more of the cam members 32 to the cam tube 12. In the example provided, each of the detent mechanisms 74 includes first and second recesses 80 and 82 (best shown in FIG. 3), respectively, formed in the cam tube 12, a detent member 84 that is received in a hole 86 (best shown in FIG. 3) in an associated one of the cam members 32, and a band spring 88 that is received about the associated one of the cam members 32. The detent member 84 can be a spherical ball. The band spring 88 can be received about an associated one of the cam members 32 and can urge the detent member 84 toward the cam tube 12, as well as limit movement of the detent member 84 relative to the associated one of the cam members 32 in a radially outward direction from the cam tube 12. Receipt of the detent member 84 into the first recess 80 (FIG. 3) releasably secures the associated one of the cam members 32 to the cam tube 12 such that an associated one of the cam assemblies 14 is releasably maintained in the first position. Similarly, receipt of the detent member 84 into the second recess 82 (FIG. 3) releasably secures the associated one of the cam members 32 to the cam tube 12 such that the associated one of the cam assemblies 14 is maintained in the second position.

Figure 9:
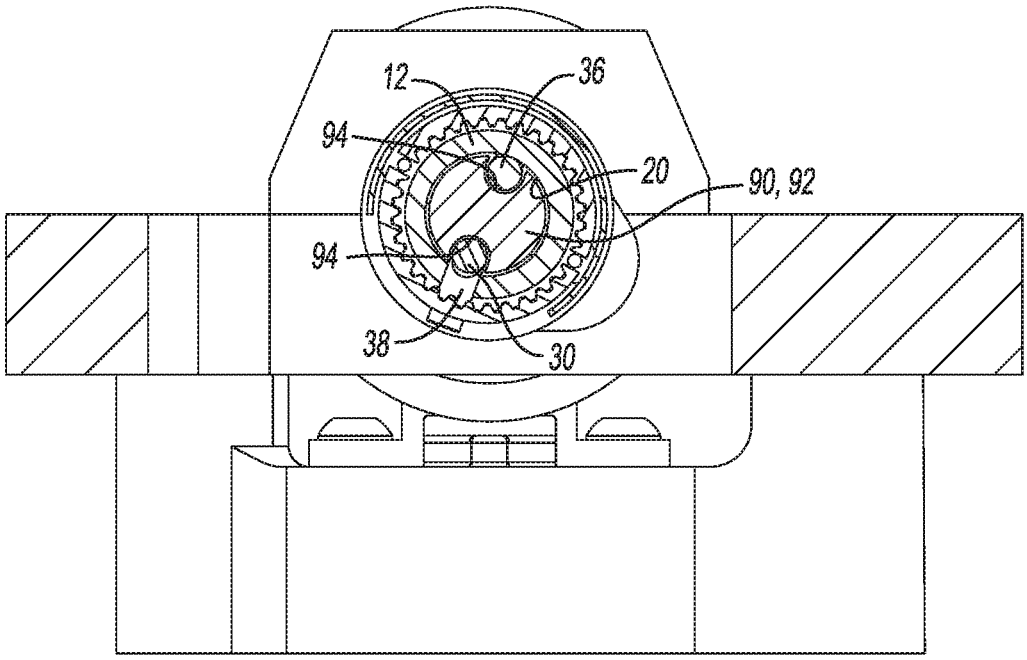
FIG. 9 is a lateral section view of the valve operating system of FIG. 1.
Figure 10:
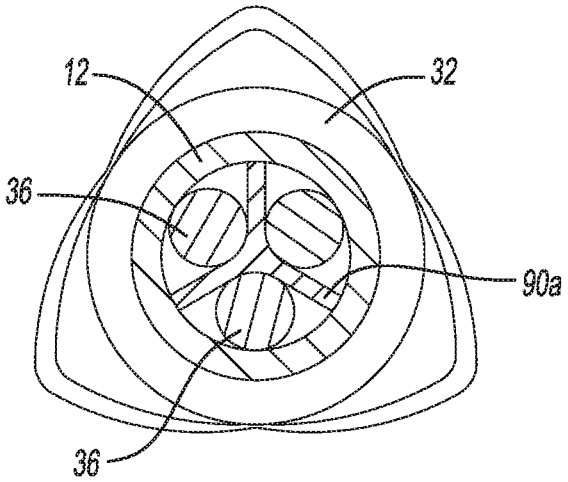
FIGS. 10 and 11 are lateral section views of alternative valve operating systems constructed in accordance with the teachings of the present disclosure.
Figure 11:
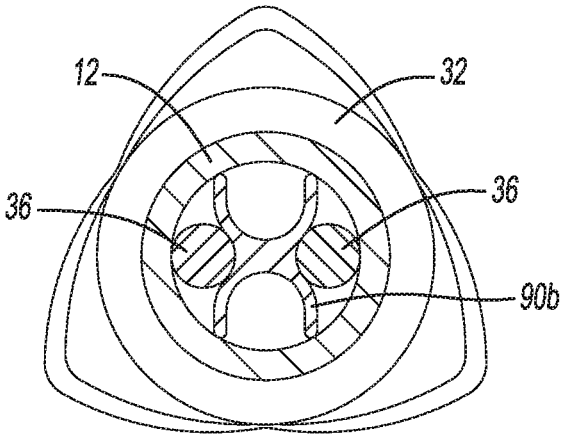

With reference to FIGS. 2 and 9, a spacer 90 can optionally be received within the hollow interior 20 of the cam tube 12 to separate the control links 30 from one another. In the particular example provided, the spacer 90 has a cylindrical body 92, which is sized to be received into the hollow interior 20 of the cam tube 12. A plurality of grooves 94 are formed into the cylindrical body 92 and intersect the outside diametrical surface of the cylindrical body 92. The grooves 94 can be spaced circumferentially about the cylindrical body 92 in a symmetrical manner and can be shaped to accommodate the link bodies 36 of the control links 30. In the example provided, the link bodies 36 are formed from a rod having a circular (lateral) cross-sectional shape and each of the grooves 94 is generally U-shaped. Each of the link bodies 36 can be received into a corresponding one of the grooves 94. It will be appreciated that the spacer 90 could be formed somewhat differently. For example, the spacer 90*a* that is depicted in FIG. 10 has a cross-sectional shape (taken laterally in a manner that is perpendicular to the rotary axis 28) that is generally Y-shaped, whereas the spacer 90*b* that is depicted in FIG. 11 has a cross-sectional shape (taken laterally perpendicular to the rotary axis 28 that is generally X-shaped. It will be appreciated that the embodiment of FIG. 10 depicts a portion of valve operating system for a six cylinder, overhead cam engine with a "V" configuration that employs three cam assemblies on each bank of the engine.

Figure 12:
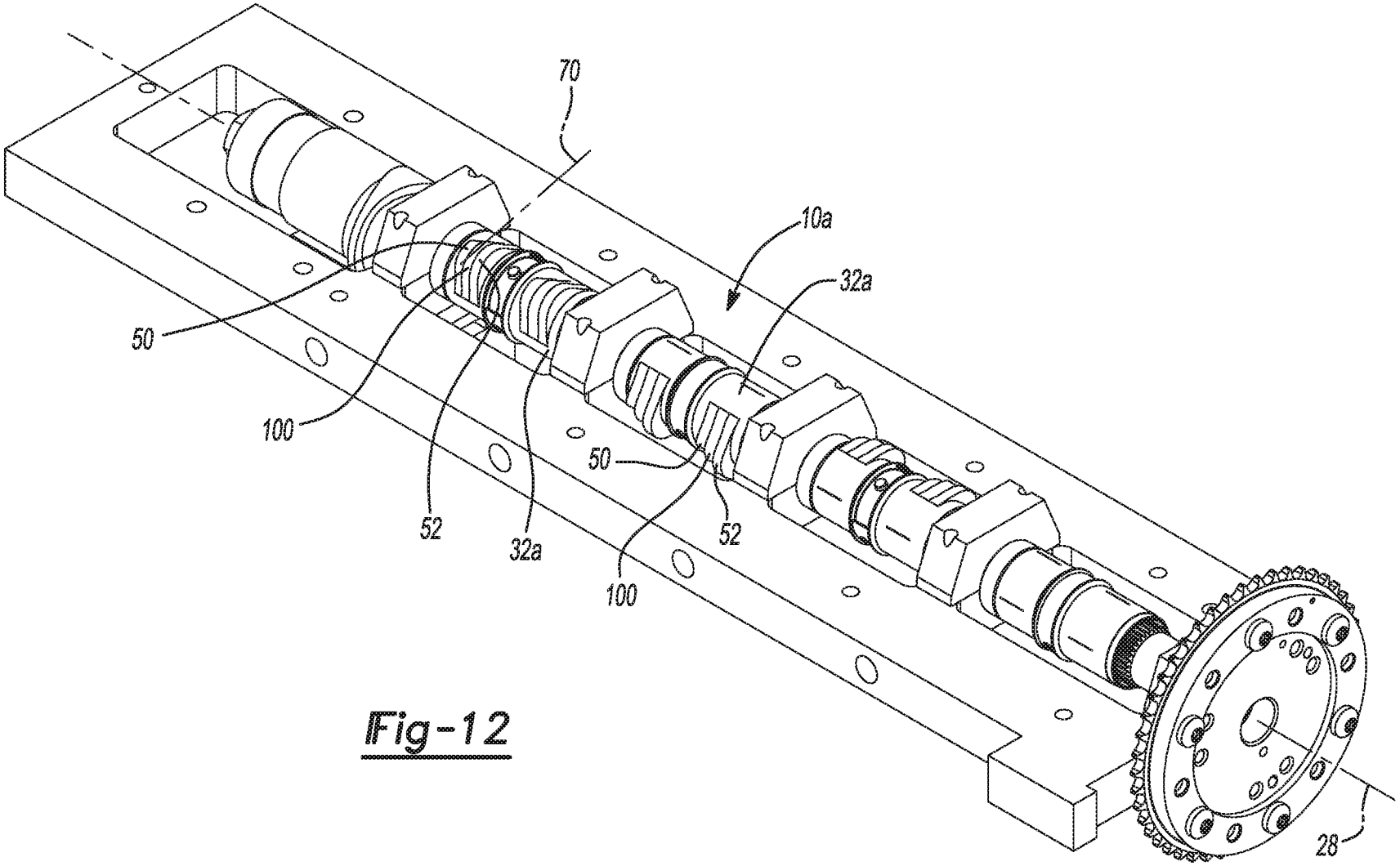
FIG. 12 is a perspective view of an internal combustion engine having another valve operating system constructed in accordance with the teachings of the present disclosure.

It will be appreciated that the present disclosure is not limited to valve operating systems having cam members with only two different cam configurations but rather can include multiple cam configurations. In the example of FIG. 12, the valve operating system 10*a* includes cam members 32*a* having a third cam configuration 100 with a third predetermined lift profile. The third predetermined lift profiles of at least a portion of the third cam configurations 100 can be different from the first predetermined lift profile and the second predetermined lift profile. In the particular example provided, each of the third cam configurations has a third predetermined lift profile that is different from the first and second predetermined lift profiles. It will be appreciated, however, that one or more of the third cam configurations can have a third predetermined lift profile that is different from the first and second predetermined lift profiles and configured to provide cylinder de-activation, while a remaining one or more of the third cam configurations can have a third predetermined lift profile that is identical to one of the first and second lift profiles. Configuration in this latter manner permits some cylinders to be deactivated while the remaining cylinders remain active. Each of the cam assemblies 14*a* is slide-able along the rotary axis 28 to a third position that is intermediate the first and second positions. Placement of the cam assemblies 14*a* into their third position correspondingly places the third cam configurations 100 in the associated activated locations and correspondingly places each of the first and second cam configurations 50 and 52 at locations that are offset along the rotary axis 28 from the associated activated locations.

With reference to FIGS. 2 and 3, the actuator 16 can include a plurality of actuator segments 110 and one or more pins 112 that can selectively interact with the actuator segments 110 to coordinate axial movement of the cam assemblies 14 along the rotary axis 28.

Figure 13:
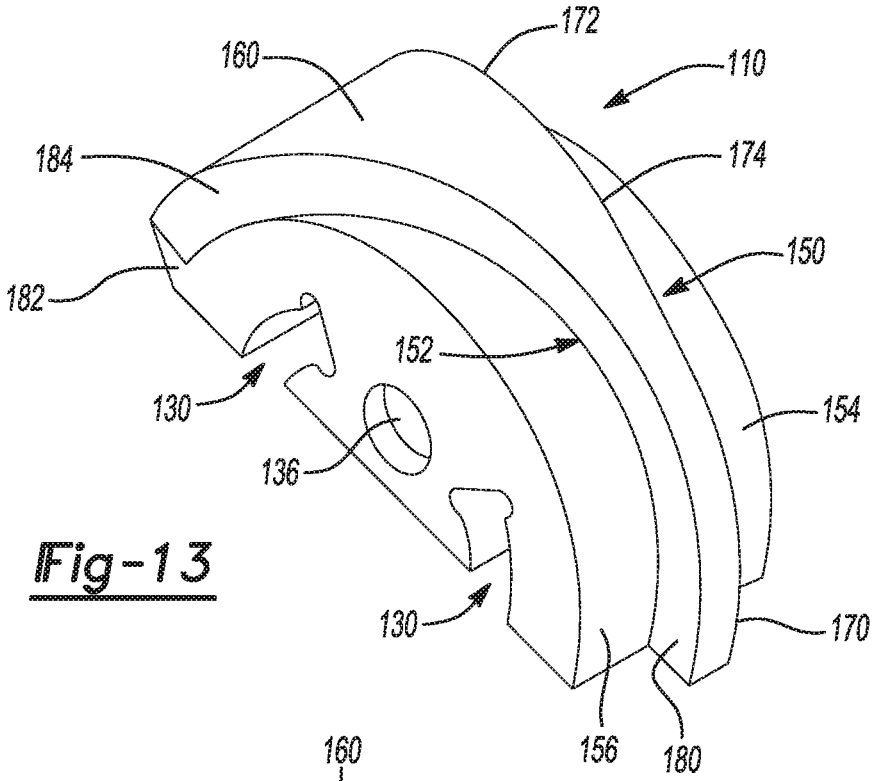
FIG. 13 is a perspective view of a portion of the valve operating system of FIG. 1 illustrating an actuator segment in more detail.
Figure 14:
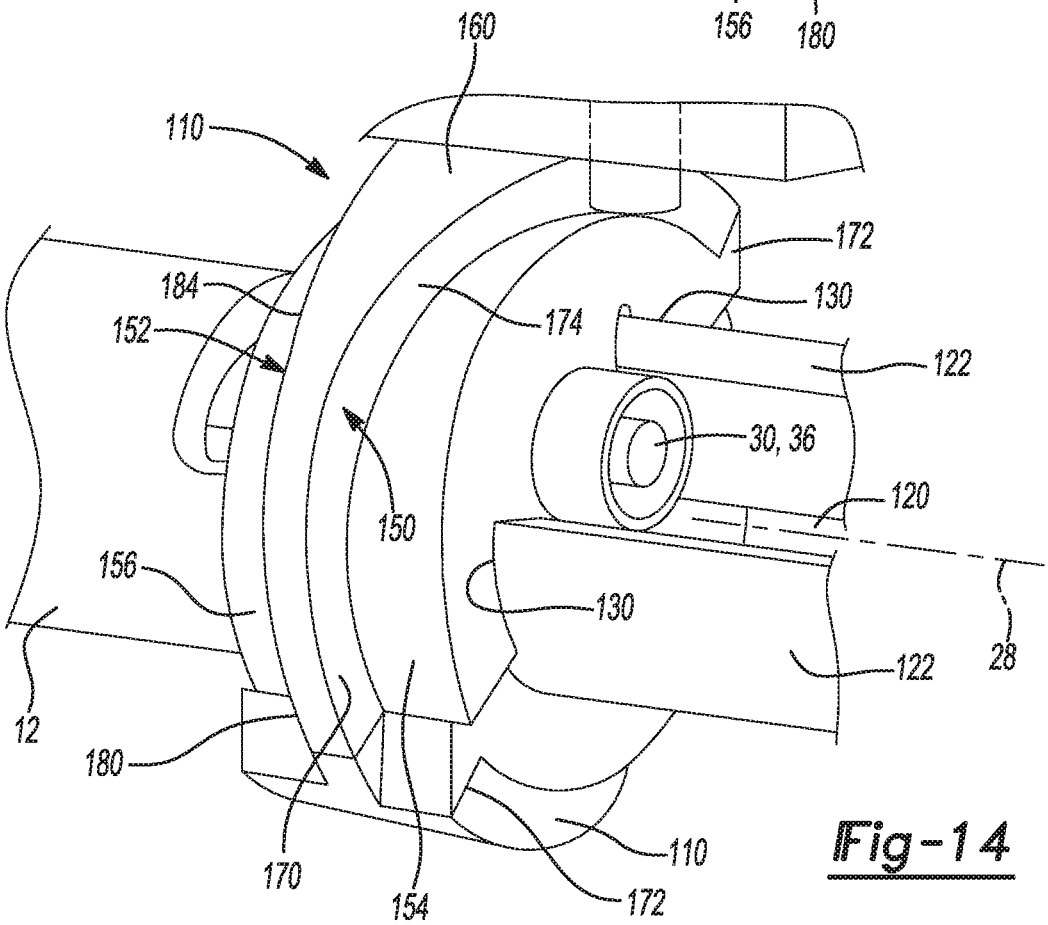
FIGS. 14 and 15 are perspective views of a portion of the valve operating system of FIG. 1 illustrating an actuator coordinating movement of the cam assemblies toward their second positions.

With reference to FIGS. 13 and 14, the actuator segments 110 can be generally shaped as an annular segment, and when collectively aligned to one another, the actuator segments 110 can form a generally annular (but segmented) structure. Each of the actuator segments 110 can be non-rotatably but axially slidably coupled to the cam tube 12 and can be axially fixed to an associated one of the control links 30. In the example provided, a pair of slots 120 is formed into an end of the cam tube 12 opposite the drive means DM (FIG. 2) to form a pair of arm members 122. It will be appreciated that while the slots 120 are depicted as extending through an axial end of the cam tube 12 (so that the slots 120 are open on one end), the slots 120 could be formed inward from the axial ends of the cam tube 12 so that the slots are closed on their opposite axial ends. Each of the actuator segments 110 is configured with a pair of circumferentially-extending slots 130 that are sized to receive corresponding portions of the arm members 122. Receipt of the arm members 122 into the circumferentially-extending slots 130 inhibits rotation of the actuator segments 110 relative to the cam tube 12 while permitting the actuator segments 110 to slide on the cam tube 12.

The link body 36 of each control link 30 can be coupled to a corresponding one of the actuator segments 110 in any desired manner. In the particular example provided, a through-hole 136 is formed in each of the actuator segments 110 and each of the link bodies 36 is received into the through-hole 136 and engaged in a press-fit manner to a corresponding one of the actuator segments 110. It will be appreciated that other coupling means, such as threads, clips, fasteners and/or flanges (e.g., formed via upsetting)

that are coupled to or integrally formed with the link bodies 36, could be employed to secure the control links 30 to the actuator segments 110.

Each of the actuator segments 110 can define first and second ramp profiles 150 and 152, respectively, that can extend in a circumferential direction about the actuator segment 110. Each of the first ramp profiles 150 on the actuator segments 110 can (but need not) be configured in an identical manner. Each of the second ramp profiles 152 on the actuator segments 110 can (but need not) be configured in an identical manner. In the example provided, the first ramp profile 150 is formed by a first groove 154 that is formed on a given one of the actuator segments 110, and the second ramp profile 152 is formed by a second groove 156 that is formed on the given one of the actuator segments 110 and spaced axially apart from the first groove 154 along the rotary axis 28. The first and second grooves 154 and 156 are disposed on opposite sides of a land 160, and the first and second ramp profiles 150 and 152 are formed on the opposite sidewalls of the land 160 (i.e., the edges of the first and second grooves 154 and 156, respectively, that form the land 160). The first ramp profile 150 can have a first ramp section 170, a second ramp section 172 that is offset axially along the rotary axis 28 from the first ramp section 170, and a first transition section 174 that is shaped "helically" about the rotary axis 28 and connects the first and second ramp sections 170 and 172. The second ramp section 172 can be relatively short and in an extreme case, consists of a single point at an end of the first transition section 174 that is opposite the first ramp section 170. The second ramp profile 152 can have a third ramp section 180, a fourth ramp section 182 that is offset axially along the rotary axis 28 from the third ramp section 180, and a second transition section 184 that is shaped helically about the rotary axis 28 and connects the third and fourth ramp sections 180 and 182. The fourth ramp section 182 can be relatively short and in an extreme case, consists of a single point at an end of the second transition section 184 that is opposite the third ramp section 180. The second ramp profile 152 can be a mirror image of the first ramp profile 150.

It will be appreciated that the first and second transition sections 174 and 184 can be shaped in any desired manner. For example, the first transition section 174 and the second transition section 184 could be configured so that as a function of the location about the circumferential surface of the actuator segment, the surface of the first or second transition section varies in a constant manner (i.e. the surface is formed as a true helix) or in a multi-staged manner, such as at an initially slower rate (e.g., to limit the axial force generated by movement of the associated cam assembly), and/or ending at a slower rate (e.g., to decelerate the associated cam assembly so as to prevent the associated one of the cam assemblies from over-traveling).

The actuator segments 110 are configured such that the first and third ramp sections 170 and 180 are disposed on one circumferential end of the actuator segment 110 and that the second and fourth ramp sections 172 and 182 are disposed on an opposite circumferential end of the actuator segment 110. When mounted on the cam tube 12, the actuator segments 110 are arranged relative to one another so that the circumferential end of one actuator segment 110 having the second and fourth ramp sections 172 and 182 is abutted against the circumferential end of another actuator segment 110 having the first and third ramp sections 170 and 180.

Figure 15:
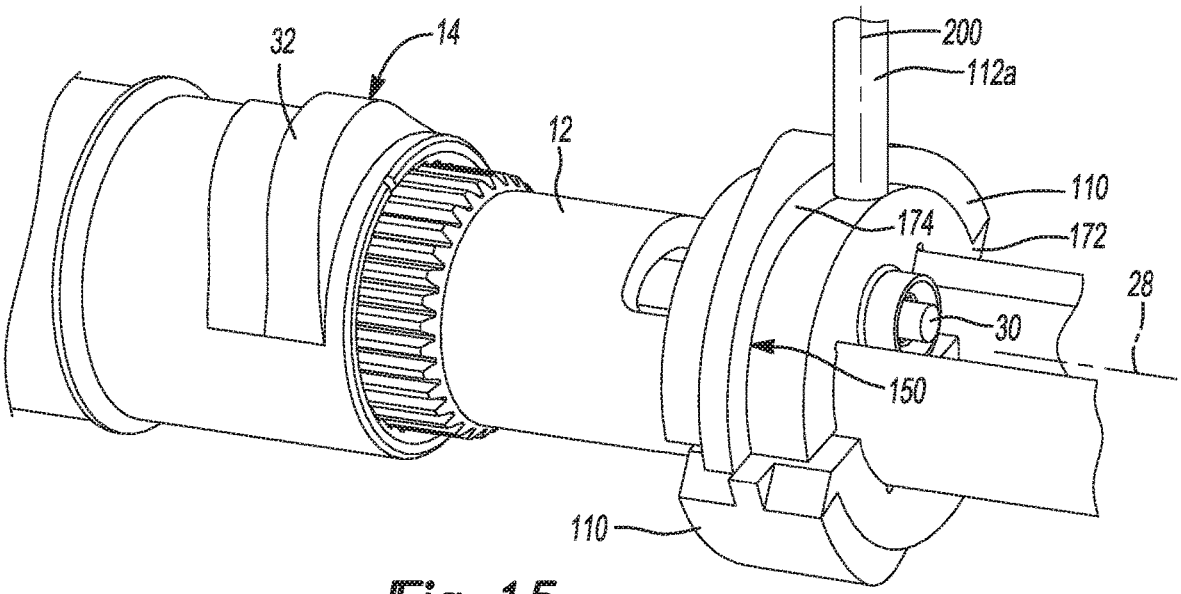
Figure 17:
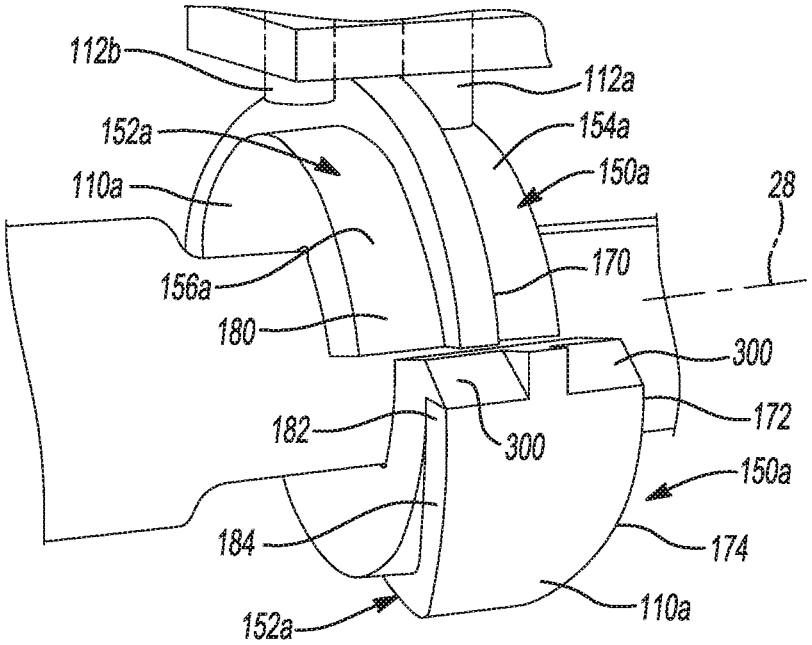
FIG. 17 is a perspective view of an alternately constructed actuator segment having an engagement portion.

With reference to FIGS. 2, 15 and 17, the actuator 16 in the example provided comprises a pair of pins 112 (i.e., a first pin 112*a* and a second pin 112*b*) that are selectively engagable to the first and second ramp profiles 150 and 152, respectively. Each of the first and second pins 112*a* and 112*b* can have a longitudinal axis 200 that can be disposed perpendicular to the rotary axis 28. The first pin 112*a* can be selectively translated toward the rotary axis 28 into engagement with the first ramp profile 150 to coordinate movement of the cam assemblies 14 from their first position to their second position. Similarly, the second pin 112*b* can be selectively translated toward the rotary axis 28 into engagement with the second ramp profile 152 to coordinate movement of the cam assemblies 14 from their second position to their first position. Any desired means can be employed to selectively translate the first pin 112*a* and the second pin 112*b*. In the example provided, a first solenoid 206 is employed to translate the first pin 112*a*, while a second solenoid 208 is employed to translate the second pin 112*b*. Each of the first and second solenoids 206 and 208 can have a plunger (not specifically shown) that can be coupled to the first pin 112*a* or second pin 112*b* for common translating motion, an electromagnetic coil (not shown) that can be energized to drive the plunger and the first pin 112*a* or the second pin 112*b* toward the rotary axis 28, and a spring (not shown) that can bias the plunger and the first pin 112*a* or second pin 112*b* away from the rotary axis 28.

Figure 8:
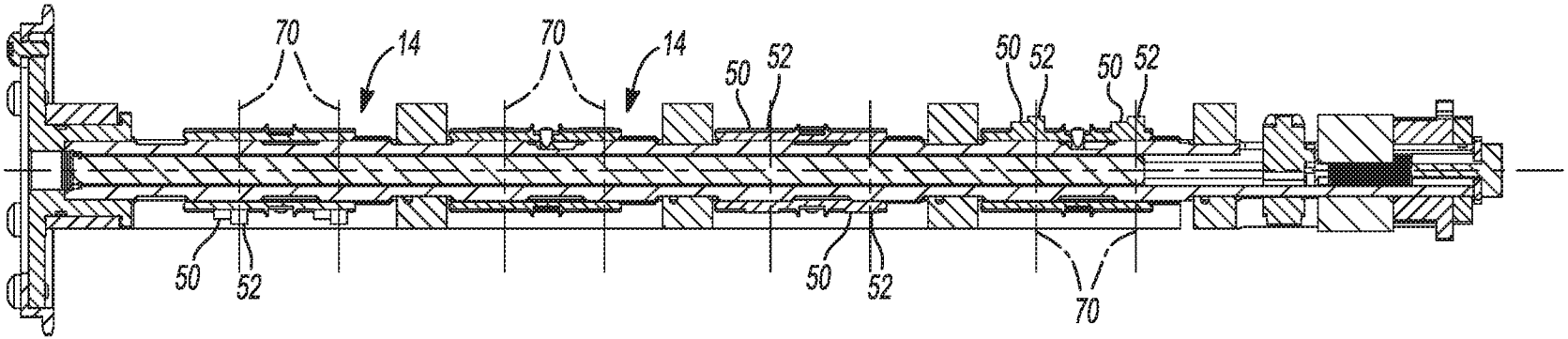

With reference to FIGS. 2 and 15, during operation of the engine and rotation of the cam assemblies 14, the actuator 16 can be selectively operated to translate the cam members 32 along the rotary axis 28 to locate a desired one of the cam configurations on each of the cam members 32 at an associated activated location 70 (FIG. 7) so that the desired cam configurations on each of the cam members 32 is employed to open corresponding sets of valves. With the cam assemblies 14 in their first positions so that the first cam configurations 50 (FIG. 5) are disposed in the associated activated locations 70 (FIG. 7), the first solenoid 206 can be operated to drive the first pin 112*a* toward the rotary axis 28 such that the first pin 112*a* is engagable to the first ramp profile 150. Rotation of the actuator segments 110 via the drive member DM causes the first pin 112*a* to "ride" along the first ramp profile 150. Contact between the first pin 112*a* and the first transition section 174 on a first one of the actuator segments 110 urges the first one of the actuator segments 110 (and an associated one of the cam assemblies 14) in a first direction axially along the rotary axis 28. Movement of the associated one of the cam assemblies 14 out of the first position causes the detent member 84 (FIG. 3) that is carried in one or more of the associated cam members 32 to disengage the first recess 80 (FIG. 3) on the cam tube 12. Translation of the first one of the actuator segments 110 and its associated cam assembly 14 in the first direction along the rotary axis terminates when the first pin 112*a* contacts the second ramp section 172, at which point the associated one of the cam assemblies 14 is disposed in its second position so that the second cam configurations 52 (FIG. 5) on the cam members 32 of the associated one of the cam assemblies 14 are disposed in their associated activated locations 70 (FIG. 8). In this position, the detent member 84 that is carried in one or more of the associated cam members 32 is received in the second recess 82 (FIG. 3) in the cam tube 12 to resist movement of the associated one of the cam assemblies 14 along the rotary axis 28 from its second position.

It will be appreciated that continued rotation of the drive member DM causes each of the remaining actuator segments 110 (and their associated cam assembly 14) to be similarly translated along the rotary axis 28 to position the remaining cam assemblies 14 in their second positions so that all of the cam members 32 are positioned along the cam tube 12 such that the second cam configurations 52 are positioned in their associated activated locations 70.

Figure 16:
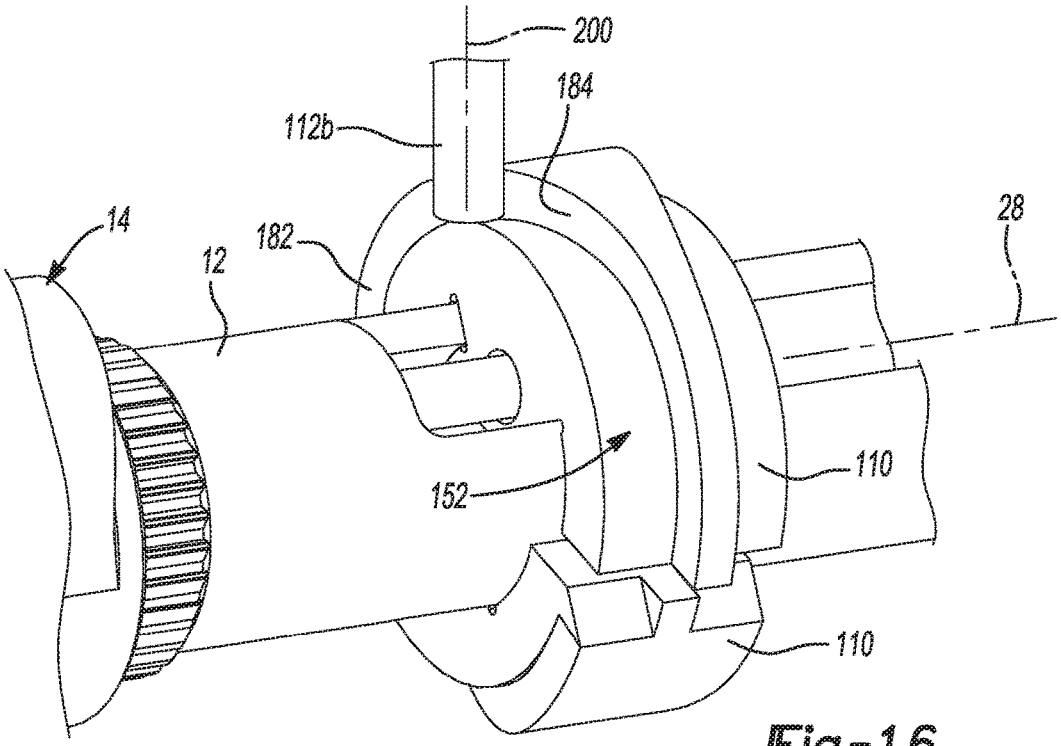
FIG. 16 is a perspective view of a portion of the valve operating system of FIG. 1 illustrating the actuator coordinating movement of the cam assemblies toward their first positions.

With reference to FIGS. 2 and 16, during operation of the engine and with the cam assemblies 14 in their second positions so that the second cam configurations 52 (FIG. 5) are disposed in the associated activated locations 70 (FIG. 8), the second solenoid 208 can be operated to drive the second pin 112*b* toward the rotary axis 28 such that the second pin 112*b* is engagable to the second ramp profile 152. Rotation of the actuator segments 110 via the drive member DM causes the second pin 112*b* to "ride" along the second ramp profile 152. Contact between the second pin 112*b* and the second transition section 184 on a first one of the actuator segments 110 urges the first one of the actuator segments 110 (and an associated one of the cam assemblies 14) in a second direction along the rotary axis 28 that is opposite the first direction. Translation of the first one of the actuator segments 110 and its associated cam assembly 14 in the second direction along the rotary axis 28 terminates when the second pin 112*b* contacts the fourth ramp section 182, at which point the associated one of the cam assemblies 14 is disposed in its first position so that the first cam configurations 50 on the cam members 32 of the associated one of the cam assemblies 14 are disposed in their associated activated locations 70. It will be appreciated that continued rotation of the drive member DM causes each of the remaining actuator segments 110 (and their associated cam assembly 14) to be similarly translated along the rotary axis 28 to position the remaining cam assemblies 14 in their first positions so that all of the cam members 32 are positioned along the cam tube 12 such that the first cam configurations 50 are positioned in their associated activated locations 70.

In FIG. 17, a portion of another valve operating system constructed in accordance with the teachings of the present disclosure is illustrated. In this example, each of the first and second ramp profiles 150*a* and 152*a*, respectively, includes an engagement section 300 that is configured to intersect the first and second grooves 154*a* and 156*a*, respectively, on an adjacent one of the actuator segments 110*a*. The engagement section 300 that is disposed in-line with the first groove 154*a* is disposed on a circumferential side of the second ramp section 172 that is opposite the first transition section 174 and tapers radially inwardly with increasing circumferential distance from the first transition section 174. Similarly, the engagement section 300 that is disposed in-line with the second groove 156 is disposed on a circumferential side of the fourth ramp section 182 that is opposite the second transition section 184 and tapers radially inwardly with increasing circumferential distance from the second transition section 184. Each engagement portion 300 is configured to permit "early" contact between the actuator segment 110*d* and an associated one of the first and second pins 112*a* and 112*b*. For example, the first pin 112*a* can be translated toward the rotary axis 28 and can contact the engagement section 300 on a first one of the actuator segments 110*d* so as to be fully seated when the first pin 112*a* engages the first transition section 170 on a next one of the actuator segments 110*a*. Given the rotational speed of the camshaft of a conventional engine, which can vary between 300 rotations per minute to 3500 rotations per minute, the presence of the engagement section 300 on one or more of the actuator segments 110*a* effectively lengthens the first and third ramp sections 170 and 180 so that additional time is provided for a respective one of the first and second pins 112*a* and 112*b* to extend fully before the first pin 112*a* contacts the first transition section 174 or the second pin 112*b* contacts the second transition section 184.

It will also be appreciated that there are various times at which the camshaft of an internal combustion engine is able to rotate in a reverse direction, such as when the internal combustion engine has been shut down while a rotary load has been applied to the crankshaft that tends to rotate the crankshaft in a rotational direction opposite the rotational direction it would rotate when the internal combustion engine is running. In such cases, the actuator segments 110*a* could damage any of the pins 112*a*, 112*b* that would be driven into contact with the second ramp section 172 or fourth ramp section 182 of an actuator segment 110*a* as the actuator segments 110*a* are rotated in the opposite rotational direction. The engagement sections 300, however, help to guard against damage to the pins 112*a*, 112*b* in such situations by causing the pins 112*a*, 112*b* to lift onto the actuator segment 110*a* as the actuator segment 110*a* is rotated in its opposite rotational direction.

Figure 18:
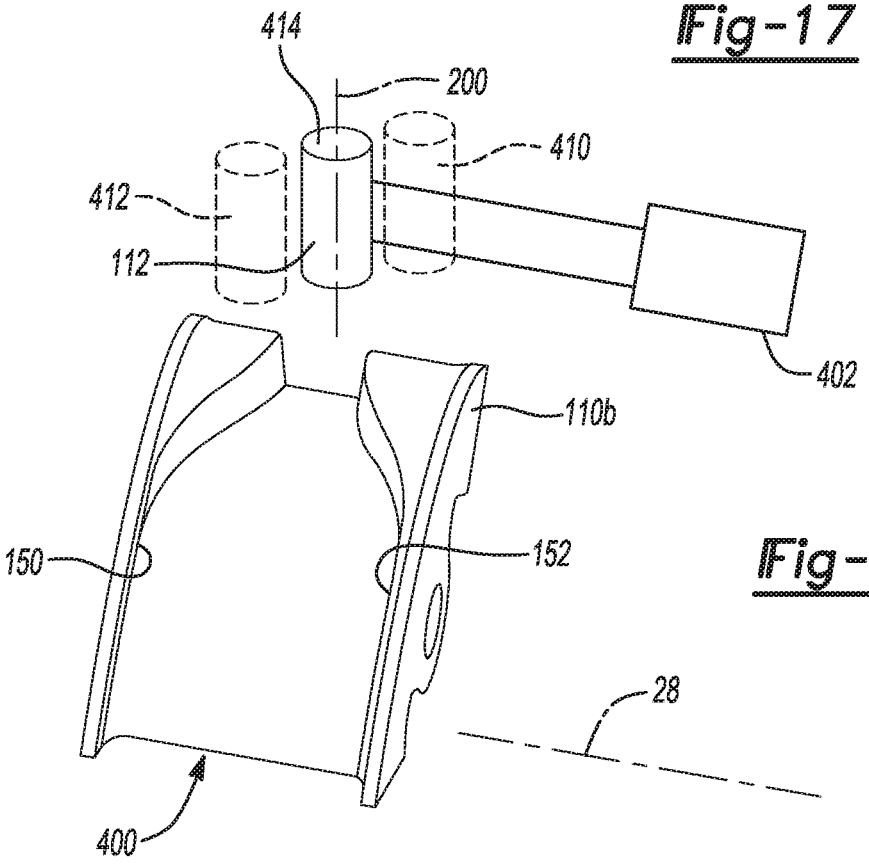
FIG. 18 is a perspective view of another alternately constructed actuator having an actuator segment with a single groove.

In FIG. 18, a portion of still another valve operating system constructed in accordance with the teachings of the present disclosure is illustrated. In this example, the actuator segments 110*b* are formed via a single groove 400, with the first and second ramp profiles 150 and 152 be formed on the opposite sidewalls of the single groove 400. If desired, the first and second ramp profiles 150 and 152 can be spaced axially apart from one another along the rotary axis 28. If desired, a single pin 112 can be selectively employed to engage the first and second ramp profiles 150 and 152 to coordinate movement of the actuator segments 110*b* along the rotary axis 28. The single pin 112 can be maintained within the single groove 400 with its longitudinal axis 200 being perpendicular to the rotary axis 28 and can be translated along the rotary axis 28 via a solenoid 402 to alternately contact the first ramp profile 150 and the second ramp profile 152.

In the example provided, the single pin 112 is movable along the rotary axis 28 between a first pin position 410, a second position 412 and a third or intermediate position 414 that is disposed between the first and second positions 410 and 412. With the drive member DM (FIG. 2) rotating and the actuator segments 110*b* in their first positions, the cam assemblies 14 (FIG. 2) can be disposed along the rotary axis 28 in their first positions so that the first cam configurations 50 (FIG. 5) are positioned in the associated activated locations. When the single pin 112 is placed in the intermediate pin position 414, the single pin 112 can contact the first ramp profile 150 of the actuator segments 110*b* as they rotate about the rotary axis 28, which can drive the actuator segments 110*b* and the cam assemblies 14 (FIG. 2) in the first direction along the rotary axis 28 so that the cam assemblies 14 (FIG. 2) can be disposed along the rotary axis 28 in third positions that are intermediate the first and second positions so that third cam configurations on the cam members are positioned in the associated activated locations. When the single pin 112 is moved further to the second pin position, the single pin 112 can contact the first ramp profile 150 of the actuator segments 110*b* as they rotate about the rotary axis 28, which can drive the actuator segments 110*b* and the cam assemblies 14 (FIG. 2) in the first direction along the rotary axis 28 so that the cam assemblies 14 (FIG. 2) can be disposed along the rotary axis 28 in the second positions so that the second cam configurations on the cam members are positioned in the associated activated locations.

Thereafter, the single pin 112 can first be moved from the second position to the intermediate position to contact the second ramp profile 152 on the actuator segments 110*b* to translate the cam assemblies to their intermediate positions, and thereafter the single pin 112 can be moved from the intermediate position 414 to the first position 410 to contact the second ramp profile 152 on the actuator segments 110*b* to translate the cam assemblies to their first positions.

Figure 20:
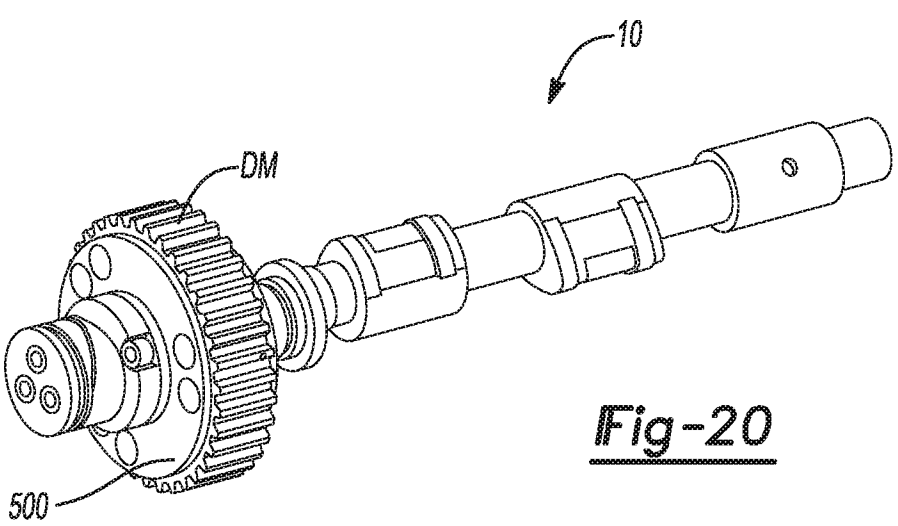
FIGS. 19 and 20 are perspective views of still another valve operating system constructed in accordance with the teachings of the present disclosure.
Figure 19:
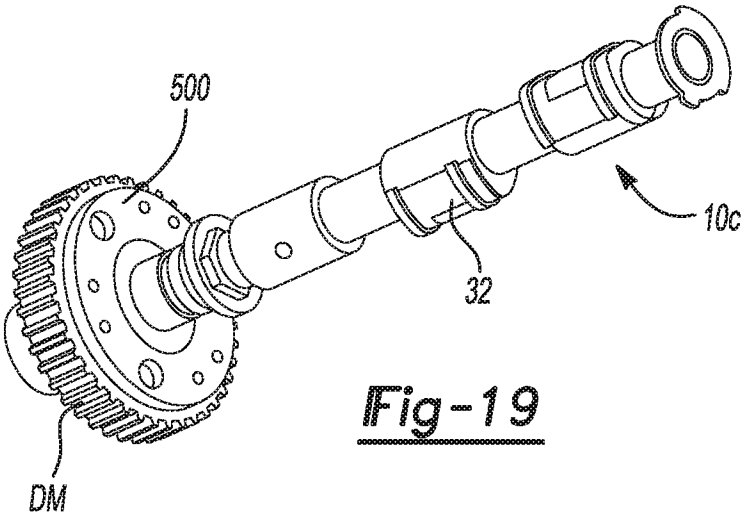
Figure 21:
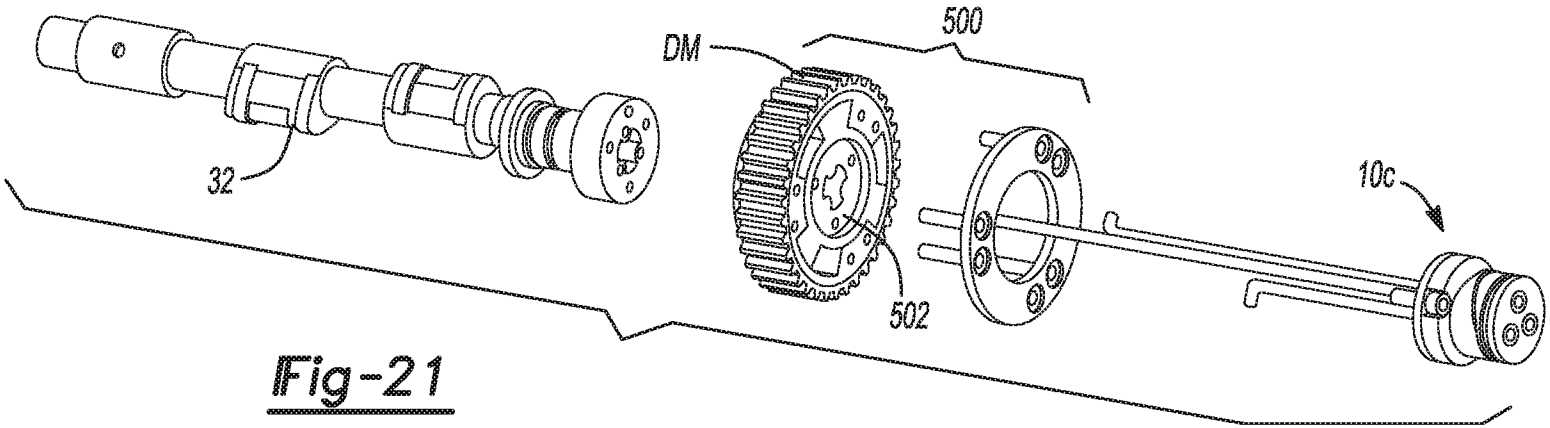
FIG. 21 is an exploded perspective view of the valve operating system of FIGS. 19 and 20.

The example of FIGS. 19 through 21, another valve operating system 10*c* is illustrated. The valve operating system 10*c* is generally identical to that of FIG. 1, except that the valve operating system 10*c* includes a variable valve timing mechanism 500 and the cam tube 12 is non-rotatably coupled to a rotor 502 of the variable valve timing mechanism 500. It will be appreciated that the rotor 502 of the variable valve timing mechanism 500 is pivotable about the drive means DM to vary the rotational position of the cam members 32 relative to the drive means DM.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A valve operating system comprising:

a cam tube that is rotatable about a rotary axis;

a plurality of cam assemblies, each of the cam assemblies having a control link and a first cam member, each of the control links having a link body that forms a majority of the control link, the link body extending parallel to the rotary axis, the link bodies being received in the cam tube, each of the first cam members being mounted on the cam tube and coupled to a corresponding one of the control links for axial movement therewith along the rotary axis, each of the first cam members having a first cam configuration and a second cam configuration, the first cam configuration having a first predetermined lift profile, the second cam configuration having a second predetermined lift profile that is different from the first predetermined lift profile, wherein each of the cam assemblies is slideable along the rotary axis between a first position, in which the first cam configurations are positioned in associated activated locations and each of the second cam configurations are offset along the rotary axis from their associated activated location, and a second position, in which the second cam configurations are positioned in the associated activated locations and each of the first cam configurations are offset along the rotary axis from their associated activated location; and a plurality of actuator segments, each of the actuator segments extending about a portion of a circumference of the cam tube, each of the actuator segments being non-rotatably but axially slidably coupled to the cam tube and axially fixed to an associated one of the control links, each of the actuator segments defining first and second ramp profiles that extend in a circumferential direction about the actuator segment, the first ramp profile having a first ramp section and a second ramp section that is offset axially along the rotary axis from the first ramp section, the second ramp profile having a third ramp section and a fourth ramp section that is offset axially along the rotary axis from the third ramp section, wherein the actuator segments are movable between a first position, in which the first ramp profiles are aligned to one another so as to extend continuously in a circumferential direction, and a second position in which the second ramp profiles are aligned to one another so as to extend continuously in the circumferential direction.

2. The valve operating system of claim 1, wherein the first ramp profile is formed by a first groove and the second ramp profile is formed by a second groove that is spaced axially apart from the first groove along the rotary axis.

3. The valve operating system of claim 2, further comprising a first pin that is selectively engagable to the first ramp profile and a second pin that is selectively engagable to the second ramp profile.

4. The valve operating system of claim 3, wherein each of the first and second pins has a longitudinal axis that is disposed perpendicular to the rotary axis.

5. The valve operating system of claim 3, further comprising first and second solenoids, the first solenoid being selectively operable for translating the first pin radially toward the rotary axis, the second solenoid being selectively operable for translating the second pin radially toward the rotary axis.

6. The valve operating system of claim 1, wherein the first and second ramp profiles are formed by a common groove.

7. The valve operating system of claim 6, wherein the first and second ramp profiles are spaced axially apart from one another.

8. The valve operating system of claim 6, further comprising at least one pin that is selectively engagable to the first ramp profile and the second ramp profile.

9. The valve operating system of claim 8, wherein the at least one pin has a longitudinal axis that is disposed perpendicular to the rotary axis.

10. The valve operating system of claim 9, further comprising at least one solenoid that is selectively operable for translating the at least one pin into engagement with the first ramp profile on the actuator segments.

11. The valve operating system of claim 10, wherein the at least one solenoid is configured to translate the at least one pin parallel to the rotary axis.

12. The valve operating system of claim 1, wherein the cam tube defines a plurality of arm members onto which the actuator segments are non-rotatably and axially slidably mounted.

13. The valve operating system of claim 12, wherein the arm members number two in quantity.

14. The valve operating system of claim 1, further comprising at least one pin that is selectively engagable to the first and second ramp profiles.

15. The valve operating system of claim 1, wherein the first and second ramp profiles are different from one another so as not to have reflection symmetry about a plane that is perpendicular to the rotary axis and equidistant from the first and second ramp profiles.

16. A valve operating system comprising:

a cam tube that is rotatable about a rotary axis;

a plurality of cam assemblies, each of the cam assemblies having a control link and a first cam member, each of the control links having a link body that forms a majority of the control link, the link body extending parallel to the rotary axis, the link bodies being received in the cam tube, each of the first cam members being mounted on the cam tube and coupled to a corresponding one of the control links for axial movement therewith along the rotary axis, each of the first cam members having a first cam configuration and a second cam configuration, the first cam configuration having a first predetermined lift profile, the second cam configuration having a second predetermined lift profile that is different from the first predetermined lift profile, wherein each of the cam assemblies is slideable along the rotary axis between a first position, in which the first cam configurations are positioned in associated activated locations and each of the second cam configurations are offset along the rotary axis from their associated activated location, and a second position, in which the second cam configurations are positioned in the associated activated locations and each of the first cam configurations are offset along the rotary axis from their associated activated location;

a plurality of actuator segments, each of the actuator segments extending about a portion of a circumference of the cam tube, each of the actuator segments being non-rotatably but axially slidably coupled to the cam tube and axially fixed to an associated one of the control links, each of the actuator segments defining first and second ramp profiles that extend in a circumferential direction about the actuator segment, the first ramp profile having a first ramp section and a second ramp section that is offset axially along the rotary axis from the first ramp section, the second ramp profile having a third ramp section and a fourth ramp section that is offset axially along the rotary axis from the third ramp section; and a first pin that is selectively engagable to the first ramp profile and a second pin that is selectively engagable to the second ramp profile;

wherein the first ramp profile is formed by a first groove and the second ramp profile is formed by a second groove that is spaced axially apart from the first groove along the rotary axis; and wherein the first ramp profile of at least one of the actuator segments comprises an engagement section, wherein the second ramp section is disposed between a first transition section that is disposed between the first and second ramp sections and the engagement section, wherein a portion of the first groove that forms the engagement section has bottom wall that tapers radially inwardly with increasing circumferential distance from the second ramp portion, the engagement section being configured to receive the first pin without contact between the first pin and the engagement section causing movement of the at least one of the actuator segments along the rotary axis.

17. The valve operating system of claim 16, wherein each of the first and second pins has a longitudinal axis that is disposed perpendicular to the rotary axis.

18. The valve operating system of claim 16, further comprising first and second solenoids, the first solenoid being selectively operable for translating the first pin radially toward the rotary axis, the second solenoid being selectively operable for translating the second pin radially toward the rotary axis.

19. The valve operating system of claim 16, wherein the first and second ramp profiles are formed by a common groove.

20. The valve operating system of claim 19, wherein the first and second ramp profiles are spaced axially apart from one another.

21. The valve operating system of claim 19, further comprising at least one pin that is selectively engagable to the first ramp profile and the second ramp profile.

22. The valve operating system of claim 21, wherein the at least one pin has a longitudinal axis that is disposed perpendicular to the rotary axis.

23. The valve operating system of claim 22, further comprising at least one solenoid that is selectively operable for translating the at least one pin into engagement with the first ramp profile on the actuator segments.

24. The valve operating system of claim 23, wherein the at least one solenoid is configured to translate the at least one pin parallel to the rotary axis.

25. The valve operating system of claim 16, wherein the cam tube defines a plurality of arm members onto which the actuator segments are non-rotatably and axially slidably mounted.

26. The valve operating system of claim 16, wherein the first and second ramp profiles are different from one another so as not to have reflection symmetry about a plane that is perpendicular to the rotary axis and equidistant from the first and second ramp profiles.

27. The valve operating system of claim 16, wherein the first ramp profile has a first transition section that is disposed between the first ramp section and the second ramp section, wherein the second ramp profile has a second transition section that is disposed between the third ramp section and the fourth ramp section, and wherein the first and second transition sections are not mirror images of one another.

28. A valve operating system comprising:

a cam tube that is rotatable about a rotary axis;

a plurality of cam assemblies, each of the cam assemblies having a control link and a first cam member, each of the control links having a link body that forms a majority of the control link, the link body extending parallel to the rotary axis, the link bodies being received in the cam tube, each of the first cam members being mounted on the cam tube and coupled to a corresponding one of the control links for axial movement therewith along the rotary axis, each of the first cam members having a first cam configuration and a second cam configuration, the first cam configuration having a first predetermined lift profile, the second cam configuration having a second predetermined lift profile that is different from the first predetermined lift profile, wherein each of the cam assemblies is slideable along the rotary axis between a first position, in which the first cam configurations are positioned in associated activated locations and each of the second cam configurations are offset along the rotary axis from their associated activated location, and a second position, in which the second cam configurations are positioned in the associated activated locations and each of the first cam configurations are offset along the rotary axis from their associated activated location; and a plurality of actuator segments, each of the actuator segments extending about a portion of a circumference of the cam tube, each of the actuator segments being non-rotatably but axially slidably coupled to the cam tube and axially fixed to an associated one of the control links, each of the actuator segments defining first and second ramp profiles that extend in a circumferential direction about the actuator segment, the first ramp profile having a first ramp section and a second ramp section that is offset axially along the rotary axis from the first ramp section, the second ramp profile having a third ramp section and a fourth ramp section that is offset axially along the rotary axis from the third ramp section;

wherein the first ramp profile has a first transition section that is disposed between the first ramp section and the second ramp section, wherein the second ramp profile has a second transition section that is disposed between the third ramp section and the fourth ramp section, and wherein the first and second transition sections are not mirror images of one another.

29. The valve operating system of claim 28, further comprising first and second solenoids, the first solenoid being selectively operable for translating the first pin radially toward the rotary axis, the second solenoid being selectively operable for translating the second pin radially toward the rotary axis.

30. The valve operating system of claim 28, wherein the first and second ramp profiles are formed by a common groove.

31. The valve operating system of claim 30, wherein the first and second ramp profiles are spaced axially apart from one another.

32. The valve operating system of claim 28, wherein the cam tube defines a plurality of arm members onto which the actuator segments are non-rotatably and axially slidably mounted.

* * * * *